US009957454B2

(12) United States Patent
Morris et al.

(10) Patent No.: US 9,957,454 B2
(45) Date of Patent: May 1, 2018

(54) METHOD AND ADDITIVE FOR CONTROLLING NITROGEN OXIDE EMISSIONS

(71) Applicant: ADA-ES, INC., Highlands Ranch, CO (US)

(72) Inventors: William J. Morris, Evergreen, CO (US); Kenneth E. Baldrey, Denver, CO (US); Constance Senior, Littleton, CO (US); Ramon Bisque, Golden, CO (US)

(73) Assignee: ADA-ES, Inc., Highlands Ranch, CO (US)

( * ) Notice: Subject to any disclaimer, the term of this patent is extended or adjusted under 35 U.S.C. 154(b) by 27 days.

(21) Appl. No.: 13/964,441

(22) Filed: Aug. 12, 2013

(65) Prior Publication Data

US 2014/0041561 A1 Feb. 13, 2014

Related U.S. Application Data

(60) Provisional application No. 61/682,040, filed on Aug. 10, 2012, provisional application No. 61/704,290, filed on Sep. 21, 2012, provisional application No. 61/724,634, filed on Nov. 9, 2012, provisional application No. 61/792,827, filed on Mar. 15, 2013.

(51) Int. Cl.

| | |
|---|---|
| ***C10L 5/00*** | (2006.01) |
| ***C10L 5/32*** | (2006.01) |
| ***F23J 7/00*** | (2006.01) |
| ***C10L 9/10*** | (2006.01) |
| ***C10L 10/00*** | (2006.01) |

(52) U.S. Cl.

CPC ..... *C10L 5/32* (2013.01); *C10L 9/10* (2013.01); *C10L 10/00* (2013.01); *F23J 7/00* (2013.01); *C10L 2200/0204* (2013.01); *C10L 2200/029* (2013.01); *C10L 2200/0259* (2013.01); *C10L 2230/04* (2013.01); *C10L 2290/02* (2013.01); *C10L 2290/06* (2013.01); *C10L 2290/24* (2013.01); *F23K 2201/505* (2013.01)

(58) Field of Classification Search

CPC ..... C10L 10/00; C10L 2200/0204; C10L 2200/0259; C10L 2200/029; C10L 2290/02; C10L 2290/06; C10L 2290/24; C10L 5/32; C10L 9/10; F23J 7/00; F23K 2201/505

USPC ..... 44/620

See application file for complete search history.

(56) References Cited

U.S. PATENT DOCUMENTS 4,212,853 A 7/1980 Fukui
4,678,481 A 7/1987 Diep
(Continued)

FOREIGN PATENT DOCUMENTS

CA 2302751 C * 10/2004 ..... C01D 1/04
CN 101121906 A * 2/2008
(Continued)

OTHER PUBLICATIONS

Enlish Translation of CN 101121906 A.*
(Continued)

*Primary Examiner* — Latosha Hines
(74) *Attorney, Agent, or Firm* — Sheridan Ross P.C.

(57) ABSTRACT

The present disclosure is directed to an additive mixture and method for controlling nitrogen oxide(s) by adding the additive mixture to a feed material prior to combustion.

46 Claims, 2 Drawing Sheets

(56) References Cited

U.S. PATENT DOCUMENTS

| | | | |
|---|---|---|---|
| 4,681,687 | A | 7/1987 | Mouche |
| 4,751,065 | A | 6/1988 | Bowers |
| 4,758,371 | A | 7/1988 | Bhatia |
| 4,803,059 | A | 2/1989 | Sullivan et al. |
| 4,886,872 | A | 12/1989 | Fong |
| 4,992,209 | A | 2/1991 | Smyk |
| 5,037,579 | A | 8/1991 | Matchett |
| 5,047,219 | A | 9/1991 | Epperly et al. |
| 5,120,516 | A | 6/1992 | Ham et al. |
| 5,277,135 | A | 1/1994 | Dubin |
| 5,387,393 | A | 2/1995 | Braden |
| 5,415,783 | A | 5/1995 | Johnson |
| 5,648,508 | A | 7/1997 | Yaghi |
| 6,083,403 | A | 7/2000 | Tang |
| 6,348,178 | B1 | 2/2002 | Sudduth et al. |
| 6,572,789 | B1 | 6/2003 | Yang |
| 6,682,709 | B2 | 1/2004 | Sudduth et al. |
| 6,694,900 | B2 | 2/2004 | Lissianski et al. |
| 6,702,569 | B2 | 3/2004 | Kobayashi et al. |
| 6,729,248 | B2 | 5/2004 | Johnson et al. |
| 6,740,133 | B2 | 5/2004 | Hundley, Jr. |
| 6,761,868 | B2 | 7/2004 | Brooks et al. |
| 6,773,471 | B2 | 8/2004 | Johnson et al. |
| 6,860,911 | B2 | 3/2005 | Hundley |
| 6,883,444 | B2 | 4/2005 | Logan et al. |
| 6,953,494 | B2 | 10/2005 | Nelson, Jr. |
| 7,008,603 | B2 | 3/2006 | Brooks et al. |
| 7,013,817 | B2 | 3/2006 | Stowe, Jr. et al. |
| 7,111,591 | B2 | 9/2006 | Schwab et al. |
| 7,217,401 | B2 | 5/2007 | Ramme et al. |
| 7,332,002 | B2 | 2/2008 | Johnson et al. |
| 7,430,969 | B2 | 10/2008 | Stowe, Jr. et al. |
| 7,497,076 | B2 | 3/2009 | Funk et al. |
| 7,651,541 | B2 | 1/2010 | Hundley et al. |
| 7,674,442 | B2 | 3/2010 | Comrie |
| 7,712,306 | B2 | 5/2010 | White et al. |
| 7,758,827 | B2 | 7/2010 | Comrie |
| 7,776,301 | B2 | 8/2010 | Comrie |
| 7,862,630 | B2 | 1/2011 | Hundley et al. |
| 7,906,090 | B2 | 3/2011 | Ukai et al. |
| 7,955,577 | B2 | 6/2011 | Comrie |
| 7,988,939 | B2 | 8/2011 | Comrie |
| 8,124,036 | B1 | 2/2012 | Baldrey et al. |
| 8,293,196 | B1 | 10/2012 | Baldrey et al. |
| 8,372,362 | B2 | 2/2013 | Durham et al. |
| 9,346,012 | B2 | 5/2016 | Pennemann et al. |
| 2003/0192234 | A1 | 10/2003 | Logan et al. |
| 2003/0196578 | A1 | 10/2003 | Logan et al. |
| 2003/0226312 | A1* | 12/2003 | Roos ..... F01N 13/009 44/280 |
| 2004/0063210 | A1 | 4/2004 | Steichen et al. |
| 2005/0147549 | A1 | 7/2005 | Lissianski et al. |
| 2006/0090678 | A1 | 5/2006 | Kriech |
| 2007/0281253 | A1 | 12/2007 | Tocian |
| 2008/0017337 | A1 | 1/2008 | Duggirala |
| 2009/0148372 | A1 | 6/2009 | Keiser |
| 2009/0287013 | A1 | 11/2009 | Morrison |
| 2010/0189617 | A1 | 7/2010 | Hundley et al. |
| 2010/0189618 | A1 | 7/2010 | White et al. |
| 2011/0262873 | A1 | 10/2011 | Nalepa et al. |
| 2012/0100053 | A1 | 4/2012 | Durham et al. |
| 2012/0124893 | A1* | 5/2012 | McRobbie ..... C10L 10/02 44/280 |
| 2012/0216729 | A1 | 8/2012 | Baldrey et al. |
| 2012/0285352 | A1* | 11/2012 | Senior ..... C10L 9/10 110/342 |
| 2012/0311924 | A1 | 12/2012 | Richardson et al. |
| 2013/0232860 | A1 | 9/2013 | Colucci et al. |
| 2013/0276682 | A1 | 10/2013 | Durham |
| 2014/0202069 | A1 | 7/2014 | Aradi et al. |
| 2015/0000187 | A1 | 1/2015 | Senior et al. |
| 2016/0137942 | A1 | 5/2016 | Senior et al. |

FOREIGN PATENT DOCUMENTS

| | | | |
|---|---|---|---|
| GB | 798872 A * | 7/1958 | ..... C08L 95/005 |
| RU | 2515988 | 5/2014 | |
| RU | 2535684 | 12/2014 | |
| WO | WO 2006/091635 | 8/2006 | |

OTHER PUBLICATIONS

Jeong et al. "Nox Removal by Selective Noncatalytic Reduction with Urea Solution in a Fluidized Bed Reactor," Korean Journal of Chemical Engineering, Sep. 1999, vol. 16, No. 5, pp. 614-617.

McCoy "Urea's Unlikely Role: Emissions Reduction is new application for chemical best known as a fertilizer," Chemical and Engineering News, Jun. 6, 2011, vol. 89, No. 23, p. 32.

Notice of Allowance for U.S. Appl. No. 13/471,015, dated May 23, 2014 10 pages.

Official Action for U.S. Appl. No. 14/484,001, dated May 19, 2015 7 pages.

Notice of Allowance for U.S. Appl. No. 14/484,001, dated Sep. 3, 2015 6 pages.

Official Action for U.S. Appl. No. 14/958,327, dated Feb. 3, 2017, 14 pages.

* cited by examiner

METHOD AND ADDITIVE FOR CONTROLLING NITROGEN OXIDE EMISSIONS

CROSS REFERENCE TO RELATED APPLICATION

The present application claims the benefits of U.S. Provisional Application Nos. 61/682,040, filed Aug. 10, 2012; 61/704,290, filed Sep. 21, 2012; 61/724,634, filed Nov. 9, 2012; and 61/792,827, filed Mar. 15, 2013, all entitled "Method to Reduce Emissions of Nitrous Oxides from Coal-Fired Boilers", each of which is incorporated herein by this reference in its entirety.

Cross reference is made to U.S. patent application Ser. No. 13/471,015, filed May 14, 2012, entitled "Process to Reduce Emissions of Nitrogen Oxides and Mercury from Coal-Fired Boilers", which claims priority to U.S. Provisional Application Nos. 61/486,217, filed May 13, 2011, and 61/543,196, filed Oct. 4, 2011, each of which is incorporated herein by this reference in its entirety.

FIELD

The disclosure relates generally to contaminant removal from gas streams and particularly to contaminant removal from combustion off-gas streams.

BACKGROUND

Coal is an abundant source of energy. While coal is abundant, the burning of coal results in significant pollutants being released into the air. In fact, the burning of coal is a leading cause of smog, acid rain, global warning, and toxins in the air (Union of Concerned Scientists). In an average year, a single, typical coal plant generates 3.7 million tons of carbon dioxide ($CO_2$), 10,000 tons of sulfur dioxide ($SO_2$), 10,200 tons of nitric oxide ($NO_x$), 720 tons of carbon monoxide (CO), 220 tons of volatile organic compounds, 225 pounds of arsenic and many other toxic metals, including mercury.

Emissions of $NO_x$ include nitric oxide (NO) and nitrogen dioxide ($NO_2$). Free radicals of nitrogen ($N_2$) and oxygen ($O_2$) combine chemically primarily to form NO at high combustion temperatures. This thermal $NO_x$ tends to form even when nitrogen is removed from the fuel. When discharged to the air, emissions of NO oxidize to form $NO_2$, which tends to accumulate excessively in many urban atmospheres. In sunlight, the $NO_2$ reacts with volatile organic compounds to form ground level ozone, eye irritants and photochemical smog.

Exhaust-after-treatment techniques can reduce significantly $NO_x$ emissions levels using various chemical or catalytic methods. Such methods are known in the art and involve selective catalytic reduction (SCR) or selective noncatalytic reduction (SNCR). Such after-treatment methods typically require some type of molecular oxygen reductant, such as ammonia, urea ($CH_4N_2O$), or other nitrogenous agent, for removal of $NO_x$ emissions.

SCR uses a solid catalyst surface to convert $NO_x$ to $N_2$. These solid catalysts are selective for $NO_x$ removal and do not reduce emissions of CO and unburned hydrocarbons. Large catalyst volumes are normally needed to maintain low levels of $NO_x$ and inhibit $NH_3$ breakthrough. The catalyst activity depends on temperature and declines with use. Normal variations in catalyst activity are accommodated only by enlarging the volume of catalyst or limiting the range of combustion operation. Catalysts may require replacement prematurely due to sintering or poisoning when exposed to high levels of temperature or exhaust contaminants. Even under normal operating conditions, the SCR method requires a uniform distribution of $NH_3$ relative to $NO_x$ in the exhaust gas. $NO_x$ emissions, however, are frequently distributed non-uniformly, so low levels of both $NO_x$ and $NH_3$ breakthrough may be achieved only by controlling the distribution of injected $NH_3$ or mixing the exhaust to a uniform $NO_x$ level.

SCR catalysts can have other catalytic effects that can undesirably alter flue gas chemistry for mercury capture. Sulfur dioxide ($SO_2$) can be catalytically oxidized to sulfur trioxide, $SO_3$, which is undesirable because it can cause problems with the operation of the boiler or the operation of air pollution control technologies, including the following: interferes with mercury capture on fly ash or with activated carbon sorbents downstream of the SCR; reacts with excess ammonia in the air preheater to form solid deposits that interfere with flue gas flow; and forms an ultrafine sulfuric acid aerosol, which is emitted out the stack.

SCR is performed typically between the boiler and air (pre) heater and, though effective in removing nitrogen oxides, represents a major retrofit for coal-fired power plants. SCR commonly requires a large catalytic surface and capital expenditure for ductwork, catalyst housing, and controls. Expensive catalysts must be periodically replaced, adding to ongoing operational costs.

Although SCR is capable of meeting regulatory $NO_x$ reduction limits, additional $NO_x$ removal prior to the SCR is desirable to reduce the amount of reagent ammonia introduced within the SCR, extend catalyst life and potentially reduce the catalyst surface area and activity required to achieve the final $NO_x$ control level. For systems without SCR installed, a $NO_x$ trim technology, such as SNCR, combined with retrofit combustion controls, such as low $NO_x$ burners and staged combustion, can be combined to achieve regulatory compliance.

SNCR is a retrofit $NO_x$ control technology in which ammonia or urea is injected post-combustion in a narrow temperature range of the flue path. SNCR can optimally remove up to 20 to 40% of $NO_x$. It is normally applied as a $NO_x$ trim method, often in combination with other $NO_x$ control methods. It can be difficult to optimize for all combustion conditions and plant load. The success of SNCR for any plant is highly dependent on the degree of mixing and distribution that is possible in a limited temperature zone. Additionally, there can be maintenance problems with SNCR systems due to injection lance pluggage and failure.

Recent tax legislation provided incentives for reducing $NO_x$ emissions by treating the combustion fuel, rather than addressing the emissions through combustion modification or SNCR or SCR type technologies downstream. To qualify for the incentive, any additive must be added before the point of combustion. The goal does not provide a straight forward solution, as the traditional reagents used to treat $NO_x$ do not survive at combustion temperatures. Therefore, a compound is required that can be mixed with the combustion fuel, move through the combustion zone, and arrive in the post-combustion zone in sufficient quantity to measurably reduce $NO_x$.

SUMMARY

These and other needs are addressed by the various aspects, embodiments, and configurations of the present disclosure. The disclosure is directed to contaminant removal by adding an additive mixture to a feed material.

The disclosure can be directed to a method for reducing $NO_x$ emissions in a pulverized coal boiler system including the steps:

(a) contacting a feed material with an additive mixture comprising an additive and a thermal stability agent to form an additive-containing feed material; and (b) combusting the additive-containing feed material to produce a contaminated gas stream including a contaminant produced by combustion of the feed material and the additive or a derivative thereof, the additive or a derivative thereof removing or causing removal of the contaminant.

The additive, in the absence of the thermal stability agent, is unstable when the feed material is combusted. In the presence of the thermal stability agent, a greater amount of the additive survives feed material combustion than in the absence of the thermal stability agent. Typically, up to about 75%, more typically up to about 60%, and even more typically up to about 50% of the additive survives feed material combustion in the presence of the thermal stability agent. Comparatively, in the absence of the thermal stability agent less than 10% of the additive commonly survives feed material combustion. For certain additives, namely urea, the additive, in the absence of the thermal stability agent, can contribute to $NO_x$ formation.

The additive can be any composition or material that is able to remove or cause removal of a targeted contaminant. For example, the additive can be a nitrogenous material targeting removal of an acid gas, such as a nitrogen oxide. Under the conditions of the contaminated gas stream, the nitrogenous material or a derivative thereof removes or causes removal of the nitrogen oxide. The nitrogenous material can include one or more of ammonia, an amine, an amide, cyanuric acid, nitride, and urea.

The additive can include multiple additives, each targeting a different contaminant. For example, the additive can include a haloamine, halamide, or other organohalide. The halogen or halide targets mercury removal while the amine or amide targets nitrogen oxide removal.

The nitrogenous material can be added to the feed material before combustion. An exemplary additive-containing feed material includes the nitrogenous material, coal, and the thermal stability agent.

The thermal stability agent can be any material that can inhibit or retard degradation or decomposition of the additive during combustion of the feed material. One type of thermal stability agent endothermically reacts with other gas stream components. Examples include a metal hydroxide, metal carbonate, metal bicarbonate, metal hydrate, and metal nitride. Another type of thermal stability agent provides a porous matrix to protect the additive from the adverse effects of feed material combustion. Exemplary thermal stability agents include zeolite, char, graphite, ash (e.g., fly ash or bottom ash) and metal oxide. Another type of thermal stability agent provides a protective coating around a portion of the additive. Exemplary thermal stability agents include a silane, siloxane, organosilane, amorphous silica, and clay.

The additive mixture can be in the form of a compound containing both the additive and thermal stability agent. Examples include a metal cyanamide and metal nitride.

The additive mixture can include other components, such as a binder to bind the additive to the thermal stability agent, a stabilizing agent, and/or dispersant. The binder can be selected to decompose during combustion of the additive-containing feed material to release the additive or a derivative thereof into the contaminated gas stream.

One additive mixture formulation is in the form of prills comprising urea and an alkaline earth metal hydroxide.

The present disclosure can provide a number of advantages depending on the particular configuration. The process of the present disclosure can broaden the operating envelope of and improve the $NO_x$ reduction performance of the SNCR while eliminating problems of reagent distribution, injection lance fouling and maintenance. It can also have a wider tolerance for process temperature variation than post-combustion SNCR since the nitrogenous reagent is introduced pre-combustion. The additive mixture can comply with $NO_x$ reduction targets set by tax legislation providing incentives for $NO_x$ reduction. The additive mixture can provide the additive with adequate protection from the heat of the combustion zone, reduce mass transfer of oxygen and combustion radicals which would break down the additive, and deliver sufficient quantities of additive to the post-flame zone to measurably reduce $NO_x$ emissions. The process can use existing boiler conditions to facilitate distribution and encourage appropriate reaction kinetics. It can use existing coal feed equipment as the motive equipment for introduction of the additives to the boiler. Only minor process-specific equipment may be required. The process can decrease the amount of pollutants produced from a fuel, while increasing the value of such fuel. Because the additive can facilitate the removal of multiple contaminants, the additive can be highly versatile and cost effective. The additive can use nitrogenous compositions readily available in certain areas, for example, the use of animal waste and the like. Accordingly, the cost for the compositions can be low and easily be absorbed by the user.

These and other advantages will be apparent from the disclosure of the aspects, embodiments, and configurations contained herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Absorption" and cognates thereof refer to the incorporation of a substance in one state into another of a different state (e.g. liquids being absorbed by a solid or gases being absorbed by a liquid). Absorption is a physical or chemical phenomenon or a process in which atoms, molecules, or ions enter some bulk phase—gas, liquid or solid material. This is a different process from adsorption, since molecules undergoing absorption are taken up by the volume, not by the surface (as in the case for adsorption).

"Adsorption" and cognates thereof refer to the adhesion of atoms, ions, biomolecules, or molecules of gas, liquid, or dissolved solids to a surface. This process creates a film of the adsorbate (the molecules or atoms being accumulated) on the surface of the adsorbent. It differs from absorption, in which a fluid permeates or is dissolved by a liquid or solid. Similar to surface tension, adsorption is generally a consequence of surface energy. The exact nature of the bonding depends on the details of the species involved, but the adsorption process is generally classified as physisorption (characteristic of weak van der Waals forces)) or chemisorption (characteristic of covalent bonding). It may also occur due to electrostatic attraction.

"Amide" refers to compounds with the functional group $R_nE(O)_xNR'_2$ (R and R' refer to H or organic groups). Most common are "organic amides" (n=1, E=C, x=1), but many other important types of amides are known including phosphor amides (n=2, E=P, x=1 and many related formulas) and sulfonamides (E=S, x=2). The term amide can refer both to classes of compounds and to the functional group ($R_nE(O)_xNR'_2$) within those compounds.

"Amines" are organic compounds and functional groups that contain a basic nitrogen atom with a lone pair. Amines are derivatives of ammonia, wherein one or more hydrogen atoms have been replaced by a substituent such as an alkyl or aryl group.

"Ash" refers to the residue remaining after complete combustion of the coal particles. Ash typically includes mineral matter (silica, alumina, iron oxide, etc.).

"Biomass" refers to biological matter from living or recently living organisms. Examples of biomass include, without limitation, wood, waste, (hydrogen) gas, seaweed, algae, and alcohol fuels. Biomass can be plant matter grown to generate electricity or heat. Biomass also includes, without limitation, plant or animal matter used for production of fibers or chemicals. Biomass further includes, without limitation, biodegradable wastes that can be burnt as fuel but generally excludes organic materials, such as fossil fuels, which have been transformed by geologic processes into substances such as coal or petroleum. Industrial biomass can be grown from numerous types of plants, including *miscanthus*, switchgrass, hemp, corn, poplar, willow, sorghum, sugarcane, and a variety of tree species, ranging from eucalyptus to oil palm (or palm oil).

"Circulating Fluidized Bed" or "CFB" refers to a combustion system for solid fuel (including coal or biomass). In fluidized bed combustion, solid fuels are suspended in a dense bed using upward-blowing jets of air. Combustion takes place in or immediately above the bed of suspended fuel particles. Large particles remain in the bed due to the balance between gravity and the upward convection of gas. Small particles are carried out of the bed. In a circulating fluidized bed, some particles of an intermediate size range are separated from the gases exiting the bed by means of a cyclone or other mechanical collector. These collected solids are returned to the bed. Limestone and/or sand are commonly added to the bed to provide a medium for heat and mass transfer. Limestone also reacts with $SO_2$ formed from combustion of the fuel to form $CaSO_4$.

"Coal" refers to a combustible material formed from prehistoric plant life. Coal includes, without limitation, peat, lignite, sub-bituminous coal, bituminous coal, steam coal, anthracite, and graphite. Chemically, coal is a macromolecular network comprised of groups of polynuclear aromatic rings, to which are attached subordinate rings connected by oxygen, sulfur, and aliphatic bridges.

"Halogen" refers to an electronegative element of group VIIA of the periodic table (e.g., fluorine, chlorine, bromine, iodine, astatine, listed in order of their activity with fluorine being the most active of all chemical elements).

"Halide" refers to a chemical compound of a halogen with a more electropositive element or group.

"High alkali coals" refer to coals having a total alkali (e.g., calcium) content of at least about 20 wt. % (dry basis of the ash), typically expressed as CaO, while "low alkali coals" refer to coals having a total alkali content of less than 20 wt. % and more typically less than about 15 wt. % alkali (dry basis of the ash), typically expressed as CaO.

"High iron coals" refer to coals having a total iron content of at least about 10 wt. % (dry basis of the ash), typically expressed as $Fe_2O_3$, while "low iron coals" refer to coals having a total iron content of less than about 10 wt. % (dry basis of the ash), typically expressed as $Fe_2O_3$. As will be appreciated, iron and sulfur are typically present in coal in the form of ferrous or ferric carbonates and/or sulfides, such as iron pyrite.

"High sulfur coals" refer to coals having a total sulfur content of at least about 1.5 wt. % (dry basis of the coal) while "medium sulfur coals" refer to coals having between about 1.5 and 3 wt. % (dry basis of the coal) and "low sulfur coals" refer to coals having a total sulfur content of less than about 1.5 wt. % (dry basis of the coal).

"Means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

"Micrograms per cubic meter" or "$\mu g/m^3$" refers to a means for quantifying the concentration of a substance in a gas and is the mass of the substance measured in micrograms found in a cubic meter of the gas.

"Neutron Activation Analysis" or "NAA" refers to a method for determining the elemental content of samples by irradiating the sample with neutrons, which create radioactive forms of the elements in the sample. Quantitative determination is achieved by observing the gamma rays emitted from these isotopes.

"Nitrogen oxide" and cognates thereof refer to one or more of nitric oxide (NO) and nitrogen dioxide ($NO_2$). Nitric oxide is commonly formed at higher temperatures and becomes nitrogen dioxide at lower temperatures.

The term "normalized stoichiometric ratio" or "NSR", when used in the context of $NO_x$ control, refers to the ratio of the moles of nitrogen contained in a compound that is injected into the combustion gas for the purpose of reducing $NO_x$ emissions to the moles of $NO_x$ in the combustion gas in the uncontrolled state.

"Particulate" and cognates thereof refer to fine particles, such as fly ash, unburned carbon, contaminate-carrying powdered activated carbon, soot, byproducts of contaminant removal, excess solid additives, and other fine process solids, typically entrained in a mercury-containing gas stream.

Pulverized coal ("PC") boiler refers to a coal combustion system in which fine coal, typically with a median diameter of 100 microns or less, is mixed with air and blown into a combustion chamber. Additional air is added to the combustion chamber such that there is an excess of oxygen after the combustion process has been completed.

The phrase "ppmw X" refers to the parts-per-million, based on weight, of X alone. It does not include other substances bonded to X.

"Separating" and cognates thereof refer to setting apart, keeping apart, sorting, removing from a mixture or combination, or isolating. In the context of gas mixtures, separating can be done by many techniques, including electrostatic precipitators, baghouses, scrubbers, and heat exchange surfaces.

A "sorbent" is a material that sorbs another substance; that is, the material has the capacity or tendency to take it up by sorption.

"Sorb" and cognates thereof mean to take up a liquid or a gas by sorption.

"Sorption" and cognates thereof refer to adsorption and absorption, while desorption is the reverse of adsorption.

"Urea" or "carbamide" is an organic compound with the chemical formula $CO(NH_2)_2$. The molecule has two —$NH_2$ groups joined by a carbonyl (C═O) functional group.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Overview

The current disclosure is directed to an additive thermal stability agent to inhibit thermal degradation of an additive for controlling contaminant emissions from contaminant evolving facilities, such as smelters, autoclaves, roasters, steel foundries, steel mills, cement kilns, power plants, waste incinerators, boilers, and other contaminated gas stream producing industrial facilities. Although any contaminant may be targeted by the additive introduction system, typical contaminants include acid gases (e.g., sulfur-containing compounds (such as sulfur dioxide and trioxide produced by thermal oxidation of sulfides), nitrogen oxides (such as nitrogen monoxide and dioxide), hydrogen sulfide ($H_2S$), hydrochloric acid (HCl), and hydrofluoric acid (HF)), mercury (elemental and/or oxidized forms), carbon oxides (such as carbon monoxide and dioxide), halogens and halides, and the like. Although the contaminant is typically evolved by combustion, it may be evolved by other oxidizing reactions, reducing reactions, and other thermal processes such as roasting, pyrolysis, and autoclaving, that expose contaminated materials to elevated temperatures.

Figure 1:
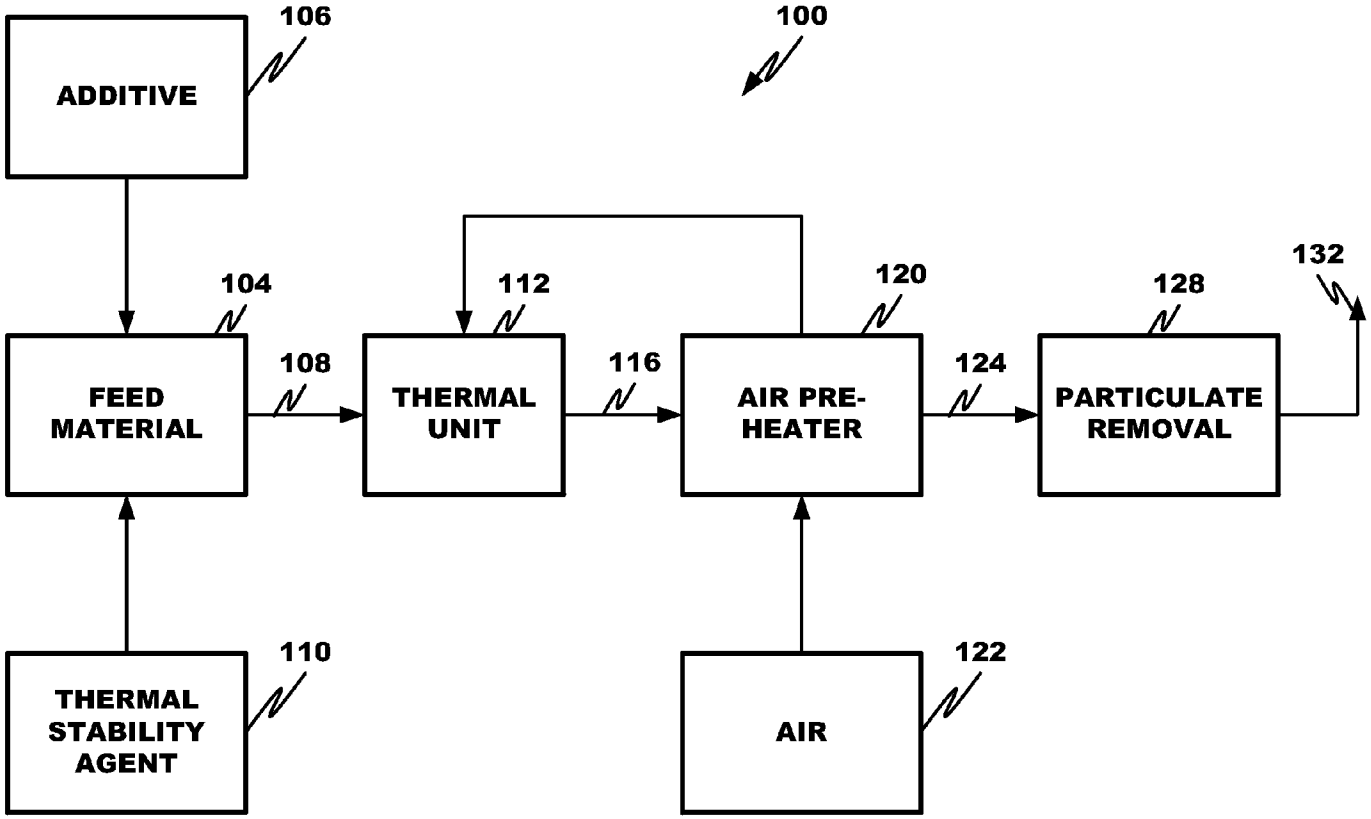
FIG. 1 is a block diagram according to an embodiment showing a common power plant configuration.

FIG. 1 depicts a contaminated gas stream treatment process 100 for an industrial facility according to an embodiment. Referring to FIG. 1, a feed material 104 is provided. In one application, the feed material 104 is combustible and can be any synthetic or natural, contaminate-containing, combustible, and carbon-containing material, including coal, petroleum coke, and biomass. The feed material 104 can be a high alkali, high iron, and/or high sulfur coal. In other applications, the present disclosure is applicable to noncombustible, contaminant-containing feed materials, including, without limitation, metal-containing ores, concentrates, and tailings.

The feed material 104 is combined with an additive 106 and thermal stability agent 110 to form an additive-containing feed material 108. The additive 106 and thermal stability agent 110 may be contacted with the feed material 104 concurrently or at different times. They may be contacted with one another and subsequently contacted with the feed material 104.

The additive-containing feed material 108 is heated in thermal unit 112 to produce a contaminated gas stream 116. The thermal unit 112 can be any heating device, including, without limitation, a dry or wet bottom furnace (e.g., a blast furnace, puddling furnace, reverberatory furnace, Bessemer converter, open hearth furnace, basic oxygen furnace, cyclone furnace, stoker boiler, cupola furnace, a fluidized bed furnace (e.g., a CFB), arch furnace, and other types of furnaces), boiler, incinerator (e.g., moving grate, fixed grate, rotary-kiln, or fluidized or fixed bed, incinerators), calciners including multi-hearth, suspension or fluidized bed roasters, intermittent or continuous kiln (e.g., ceramic kiln, intermittent or continuous wood-drying kiln, anagama kiln, bottle kiln, rotary kiln, catenary arch kiln, Feller kiln, noborigama kiln, or top hat kiln), or oven.

The contaminated gas stream 116 generally includes a number of contaminants. A common contaminated gas stream 108 includes (elemental and ionic) mercury, particulates (such as fly ash), sulfur oxides, nitrogen oxides, hydrochloric acid (HCl), other acid gases, carbon oxides, and unburned carbon.

The contaminated gas stream 116 is optionally passed through the air preheater 120 to transfer some of the thermal energy of the contaminated gas stream 116 to air 122 prior to input to the thermal unit 112. The heat transfer produces a common temperature drop in the contaminated gas stream 116 of from about 500° C. to about 300° C. to produce a cooled contaminated gas stream 124 temperature commonly ranging from about 100 to about 400° C.

The cooled contaminated gas stream 124 passes through a particulate control device 128 to remove most of the particulates (and targeted contaminant and/or derivatives thereof) from the cooled contaminated gas stream 124 and form a treated gas stream 132. The particulate control device 500 can be any suitable device, including a wet or dry electrostatic precipitator, particulate filter such as a baghouse, wet particulate scrubber, and other types of particulate removal device.

The treated gas stream 132 is emitted, via gas discharge (e.g., stack), into the environment.

The Additive

The additive depends on the particular targeted contaminant. Exemplary additives include halogens, halides, nitrogenous materials, activated carbon, lime, soda ash, and the like. While a variety of additives may be employed to remove or cause removal of a targeted contaminant, the additive typically causes removal of nitrogen oxides and other acid gases. A typical additive for removing or causing removal of nitrogen oxide is a nitrogenous material, commonly ammonia, an ammonia precursor (such as an amine (e.g., a melamine ($C_3H_3N_6$)), amide (e.g., a cyanamide ($CN_2H_2$)), and/or urea.

While not wishing to be bound by any theory, ammonia is believed to react with nitrogen oxides formed during the combustion of the feed material to yield gaseous nitrogen and water vapor according to the following global reaction:

$$2NO+2NH_3+\tfrac{1}{2}O_2 \rightarrow 2N_2+3H_2O \quad (1)$$

The optimal temperature range for Reaction (1) is from about 1550° F. to 2000° F. (843 to 1093° C.). Above 2000° F. (1093° C.), the nitrogenous compounds from the ammonia precursor may be oxidized to form NOx. Below 1550° F. (843° C.), the production of free radicals of ammonia and amines may be too slow for the global reaction to go to completion.

Without being bound by theory, an amine and/or amide can act as an ammonia precursor that, under the conditions in a thermal unit 112, thermally decomposes and/or undergoes a hydrolysis reaction to form ammonia gas, or possibly free radicals of ammonia ($NH_3$) and amines ($NH_2$) (herein referred to collectively as "ammonia").

Sources of amines or amides include any substance that, when heated, produces ammonia gas and/or free radicals of ammonia. Examples of such substances include, for example, urea, carbamide, polymeric methylene urea, animal waste, ammonia, methamine urea, cyanuric acid, and other compounds which can break down and form NH* or $NH_2$* radicals, and combinations and mixtures thereof. In an embodiment, the substance is urea. In an embodiment, the substance is animal waste. In yet other embodiments, granular long chain polymerized methylene ureas are used as additives, as the kinetics of thermal decomposition are expected to be relatively slower and therefore a larger fraction of unreacted material may still be available past the flame zone. The additive may further be any compound with an amine (e.g., $NH_2$) or amide functional group. Examples would include methyl amine, ethyl amine, butyl amine, etc.

The additive can contain a single substance for removing a targeted contaminant pollutant, or it can contain a mixture of such substances for targeting different contaminants, such as nitrogen oxides and elemental mercury. For example, the additive can contain a single substance including both an amine or amide for removing or causing removal of a nitrogen oxide and a halogen for removing or causing removal of elemental mercury. An example of such an additive is a haloamine formed by at least one halogen and at least one amine, a halamide formed by at least one halogen and at least one amide, or other organohalide including both an ammonia precursor and dissociable halogen. The precursor composition can contain a mixture of an amine and/or an amide, and a halogen.

In another embodiment, the additive will be added to the feed material along with a halogen component. Preferred methods for adding the halogen component are described in U.S. Pat. No. 8,372,362 and US 2012-0100053 A1, and US 2012-0216729 A1, each of which is incorporated herein by this reference. The halogen component may be added as an elemental halogen or a halogen precursor. Commonly, the halogen component is added to the feed material before combustion. The halogen may be added in slurry form or as a solid, including a halogen salt. In either form, the halogen may be added at the same time as, or separate from, the additive.

This list is non-exhaustive; the primary concerns are the chemical properties of the additive. A benefit of the amine and amide materials may be a slower decomposition rate, thus allowing ammonia generation to occur further downstream in the flow of the contaminated gas stream 108 than would be the case with urea and thus exposing the ammonia to less oxidation to NO than is seen with urea when introduced with the feed material to the thermal unit 112.

Commonly at least about 25%, more commonly at least most, more commonly at least about 75%, more commonly at least about 85% and even more commonly at least about 95% of the additive is added in liquid or solid form to the combustion feed material.

The additive can be formulated to withstand more effectively, compared to other forms of the additive, the thermal effects of combustion. In one formulation, at least most of the additive is added to the combustion feed material as a liquid, which is able to absorb into the matrix of the feed material. The additive will volatilize while the bulk of the feed material consumes a large fraction thermal energy that could otherwise thermally degrade the additive. The liquid formulation can include other components, such as a solvent (e.g., water surfactants, buffering agents and the like)), and a binder to adhere or bind the additive to the feed material, such as a wax or wax derivative, gum or gum derivative, and other inorganic and organic binders designed to disintegrate thermally during combustion (before substantial degradation of the additive occurs), thereby releasing the additive into the boiler or furnace freeboard, or into the off-gas.

In another formulation, at least most of the additive is added to the combustion feed material as a particulate. In this formulation, the particle size distribution ($P_{80}$ size) of the additive particles as added to the fuel commonly ranges from about 20 to about 6 mesh (Tyler), more commonly from about 14 to about 8 mesh (Tyler), and even more commonly from about 10 to about 8 mesh (Tyler).

The additive can be slurried or dissolved in the liquid formulation. A typical additive concentration in the liquid formulation ranges from about 20% to about 60%, more typically from about 35% to about 55%, and even more typically from about 45% to about 50%.

The Thermal Stability Agent

Despite the formulation of the additive to withstand the effects of combustion, the additive can still thermally degrade under the conditions in the thermal unit 112. When the additive-containing feed material is combusted for example, the additive can be thermally degraded, oxidized, or decomposed by the flame envelope. The thermal stability agent generally provides an encapsulation compound or heat sink that protects and delivers the additive through the flame envelope (and the intense chemical reactions occurring within the flame envelope), so that it survives in sufficient quantity to measurably affect contaminant (e.g., $NO_x$) emissions. As will be appreciated, the flame envelope in the thermal unit 112 typically has a temperature in excess of 2,000° F. (1093° C.).

The thermal stability agent can be a metal or metal-containing compound, such as an alkaline earth metal or alkaline earth metal-containing compound, particularly a hydroxide or carbonate or bicarbonate. Commonly, the thermal stability agent is an alkaline earth metal-containing hydroxide or carbonate, such as magnesium hydroxide or magnesium carbonate. While not wishing to be bound by any theory, it is believed that, in the combustion process, the metal hydroxide (e.g., magnesium hydroxide) or carbonate (e.g., magnesium carbonate) or metal bicarbonate calcines to a metal oxide (e.g., MgO) in an endothermic reaction. The reaction in effect creates a localized heat sink. Therefore, when mixed thoroughly with the additive (e.g., urea) the reaction product creates a heat shield, absorbing heat from the furnace flame zone or envelope in the localized area of the additive molecules. This can allow the additive to survive in sufficient quantity to target the selected contaminant (e.g., NOx) downstream of the thermal unit 112.

A common additive mixture comprises the additive, namely urea, and the thermal stability agent, namely magnesium hydroxide or carbonate. The primary active components of the additive mixture are urea and magnesium hydroxide or carbonate.

The additive mixture may not only comprise the additive and the thermal stability agent as separate components but also comprise the additive and thermal stability agent as part of a common chemical compound. For example, the mixture may comprise a metal cyanamide (e.g., an alkaline earth metal cyanamide such as calcium cyanamide (e.g., $CaCN_2$)) and/or a metal nitride (e.g., an alkaline earth metal nitride such as calcium nitride (e.g., $Ca_3N_2$)). The metal cyanamide or nitride can, depending on temperature, produce not only ammonia but also a particulate metal oxide or carbonate. Metal cyanamide, in particular, can proceed through intermediate cyanamide via hydrolysis and then onto urea formation with further hydrolysis. It may therefore offer a substantial degree of delay in urea release for subsequent ammonia production in the contaminated gas stream 108, which can be a substantial benefit relative to the additive alone.

As will be appreciated, calcium and other alkaline earth materials can perform similarly to magnesium oxide. Furthermore, any metal hydrate or hydroxide mineral can also be suitable as this family of minerals can decompose endothermically to provide the necessary sacrificial heat shield to promote survival of the additive (particularly nitrogenous materials) out of the flame envelope.

Commonly, the molar ratio of the thermal stability agent: additive ranges from about 1:1 to about 10:1, more commonly from about 1:1 to about 8:1 and even more commonly from about 1.5:1 to about 5:1.

The additive mixture can be added to the feed material either as a solid or as a slurry. Commonly, the additive mixture is added to the feed material prior to combustion. Under normal operating conditions, the additive mixture will be applied on the feed belt shortly before combustion. However, the additive mixture may be mixed with the feed material, either all at once or with the individual components added at different times, at a remote location.

Another thermal stability agent formulation comprises a thermally stable substrate matrix, other than the feed material particles, to protect the additive through the flame combustion zone or envelope. Exemplary thermally stable substrates to support the nitrogenous component include zeolites (or other porous metal silicate materials), clays, activated carbon (e.g., powdered, granular, extruded, bead, impregnated, and/or polymer coated activated carbon), char, graphite, ash (e.g., (fly) ash and (bottom) ash), metals, metal oxides, and the like.

The thermal stability agent formulation can include other components, such as a solvent (e.g., water surfactants, buffering agents and the like)), and a binder to adhere or bind the additive to the substrate, such as a wax or wax derivative, gum or gum derivative, alkaline binding agents (e.g., alkali or alkaline earth metal hydroxides, carbonates, or bicarbonates, such as lime, limestone, caustic soda, and/or trona), and/or other inorganic and organic binders designed to disintegrate thermally during combustion (before substantial degradation of the additive occurs), thereby releasing the additive into the boiler or furnace freeboard, or into the off-gas.

Figure 2:
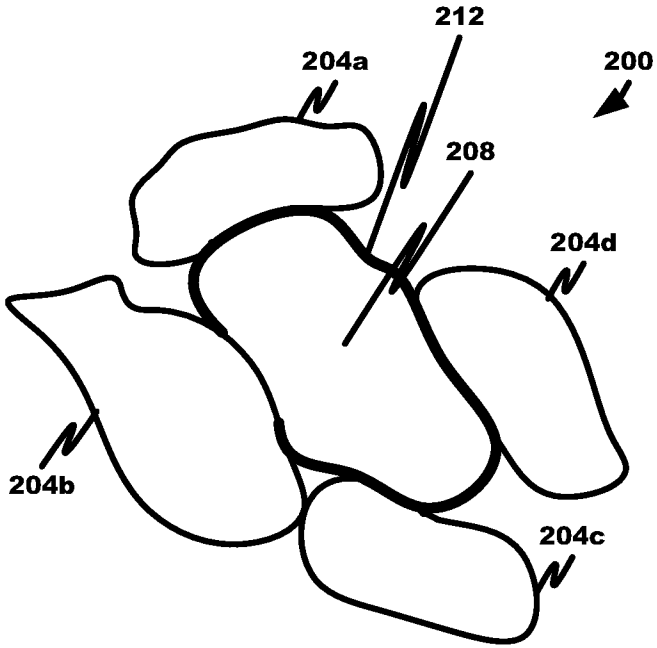
FIG. 2 is a thermal stability agent formulation according to an embodiment.

A thermal stability agent formulation 200 is shown in FIG. 2. The formulation 200 includes thermal stability agent particles 204*a-d* bound to and substantially surrounding an additive particle 208. The formulation can include a binder 212 to adhere the various particles together with sufficient strength to withstand contact with the feed material 104 and subsequent handling and transporting to the thermal unit 112. As can be seen from FIG. 2, the thermal stability agent particles 204*a-d* can form a thermally protective wall, or a surface contact heat sink, around the additive particle 208 to absorb thermal energy sufficiently for the additive particle 208 to survive combustion conditions in the thermal unit 112. The thermal stability agent formulation 200 is typically formed, or premixed, prior to contact with the feed material 104.

A common thermal stability agent formulation to deliver sufficient $NO_X$ reducing additive to the post-flame zone for NOx and/or other contaminant removal incorporates the additive into a fly ash matrix combined with one or more alkaline binding agents, such as an alkali or alkaline earth metal hydroxide (e.g., lime, limestone, and sodium hydroxide) and alkali and alkaline earth metal carbonates and bicarbonates (e.g., trona (trisodium hydrogendicarbonate dihydrate or $Na_3(CO_3)(HCO_3).2H_2O$)). This formulation can provide the additive with adequate protection from the heat of the combustion zone, reduce mass transfer of oxygen and combustion radicals which would break down the additive, and deliver sufficient quantities of the additive reagent to the post-flame zone to measurably reduce $NO_X$ and/or other contaminant emissions.

Other granular urea additives with binder may also be employed.

The additive can be mixed with substrate (e.g., fly ash) and alkaline binder(s) to form a macroporous and/or microporous matrix in which the additive becomes an integral part of the substrate matrix to form the additive mixture. The composition of the additive mixture can be such that the additive acts as a binding agent for the substrate, and it is theorized that the substrate can protect the additive from the intense heat and reactions of the flame envelope. The matrix can act as a porous structure with many small critical orifices. The orifices effectively serve as a "molecular sieve," limiting the rate at which the additive is able to escape from the matrix. The matrix acts as a heat shield, allowing for survival of the additive trapped within the matrix through the flame envelope. Properly designed, the porous matrix structure can ensure that sufficient additive arrives in the cooler flue gas zones in sufficient quantities to measurably reduce $NO_x$ and/or other contaminant levels.

Ash as an additive substrate can have advantages. Because the fly ash already went through a combustion cycle, it readily moves through the flame zone and the rest of the boiler/combustor/steam generating plant without adverse affects. Via the fly ash and alkaline stabilizer matrix, an additive can arrive in the fuel rich zone between the flame envelope and over-fire air where it is introduced, for example, to $NO_x$ molecules and can facilitate their reduction to $N_2$. In addition, in units with short gas phase residence time, the additive is designed to survive through the entire combustion process including passing through the over-fire air, if in use at a particular generating station, to introduce the additive (e.g., nitrogen containing $NO_X$ reducing agent) into the upper furnace, which is the traditional SNCR injection location. If used in operations where staged combustion is not employed, the additive is designed to survive the combustion zone and reduce $NO_X$ in the upper furnace.

The relative amounts of additive, substrate and binder depend on the application. Typically, the additive mixture comprises from about 10 to about 90 wt. %, more typically from about 20 to about 80 wt. %, and even more typically from about 30 to about 70 wt. % additive (dry weight), from about 90 to about 10 wt. %, more typically from about 80 to about 20 wt. %, and even more typically from about 70 to about 30 wt. % substrate (dry weight), and from about 0 to about 5 wt. %, more typically from about 0.1 to about 3 wt. %, and even more typically from about 0.2 to about 2 wt. % binder (dry weight). As noted, the binder is optional; therefore, it can be omitted in other additive mixture formulations.

Various methods are also envisioned for generating an additive mixture of the additive and the thermal stability agent. In one example, the substrate (e.g., recycled ash) is mixed with a liquid additive. The additive mixture then may be added to the feed material as a slurry or sludge, or as a solid matrix with varying amounts of residual moisture. In yet another aspect, the additive mixture is created by applying a liquid additive (e.g., ammonia or urea) to the substrate (e.g., recycled fly ash). The liquid additive can be introduced by dripping onto the substrate. The substrate might be presented by recycling captured fly ash or by introducing in bulk in advance of the combustion source. After applying the additive, the additive mixture is pressed into a brick or wafer. A range of sizes and shapes can function well. The shape and size of an additive mixture particle added to the feed material can be designed based on thermal unit 112 design to optimize the delivery of the additive in the thermal unit based upon the fluid dynamics present in a particular application.

In another example, the feed material is first treated by adding the substrate with the additive. Once treated, the feed material is transported and handled in the same way as untreated feed material. In power plants for example, coal pretreated with the additive mixture may be stored in a bunker, fed through a pulverizer, and then fed to the burners for combustion. During combustion, a fuel-rich environment may be created to facilitate sufficient additive survival through the flame envelope so that the additive may be mixed with and react with NOx or other targeted contaminant either in the fuel-rich zone between the burners and over fire air or in the upper thermal unit 112 depending upon the gas phase residence times within the thermal unit 112. Alternatively, the additive-containing feed material may be burned in a fuel-lean combustion condition, with the substrate matrix providing enough mass transfer inhibition such that the additive is not consumed during the flame envelope.

The following combinations and ratios of chemicals have demonstrated a high degree of thermal stability. This list is not exhaustive but rather is simply illustrative of various combinations that have shown favorable characteristics.

Fly Ash/Urea, wherein Urea is added as about a 35-40% solution in water to the fly ash. No other water is added to the mixture. The evaluated combination included 1,500 g Powder River Basin "PRB" fly ash, approximately 400 grams urea, and 600 mL water.

Fly Ash/Urea with Ca/Na, comprising: 1,500 g PRB fly ash, approximately 400 grams urea from urea solution, 300 grams NaOH, and CaO at a 1:1 molar ratio and 15% of total using hydrated lime.

Fly Ash/Urea/methylene urea, comprising: 1,500 g PRB fly ash, 300 grams powder methylene urea, and 80 grams urea from solution.

Fly Ash/Urea/Lime, comprising: 1,500 gm PRB fly ash, approximately 400 grams urea from urea solution, additional lime added (approximately 200 grams).

As will be appreciated, substrates other than fly ash, additives other than urea, and binders other than lime can be used in the above formulations.

In other formulations, the additive is combined with other chemicals to improve handing characteristics and/or support the desired reactions and/or inhibit thermal decomposition of the additive. For example, the additive, particularly solid amines or amides, whether supported or unsupported, may be encapsulated with a coating to alter flow properties or provide some protection to the materials against thermal decomposition in the combustion zone. Examples of such coatings include silanes, siloxanes, organosilanes, amorphous silica or clays.

In any of the above formulations, other thermally adsorbing materials may be applied to substantially inhibit or decrease the amount of nitrogenous component that degrades thermally during combustion. Such thermally adsorbing materials include, for example, amines and/or amides other than urea (e.g., monomethylamine and alternative reagent liquids).

The additive mixture can be in the form of a solid additive. It may be applied to a coal feed, pre-combustion, in the form of a solid additive. A common ratio in the additive mixture is from about one part thermal stability agent to one part additive to about four parts thermal stability agent to one part additive and more commonly from about 1.5 parts thermal stability agent to one part additive to about 2.50 parts thermal stability agent to one part additive.

Urea, a commonly used additive, is typically manufactured in a solid form in the form of prills. The process of manufacturing prills is well known in the art. Generally, the prills are formed by dripping urea through a "grate" for sizing, and allowing the dripped compound to dry. Prills commonly range in size from 1 mm to 4 mm and consist substantially of urea.

To form the additive mixture, the thermal stability agent (e.g., magnesium hydroxide fines or particles) can be mixed with the urea prior to the prilling process. Due to the added solid concentration in the urea prill, an additional stabilizing agent may be required. A preferred stabilizing agent is an alkaline earth metal oxide, such as calcium oxide (CaO), though other stabilizing agents known in the art could be used. The stabilizing agent is present in low levels—approximately 1% by weight—and is added prior to the prilling process. The additive created by this process is a prill with ratios of about 66 wt. % thermal stability agent (e.g., magnesium hydroxide), about 33 wt. % additive (e.g., urea), and about 1 wt. % stabilizing agent.

Once stabilized in prill form, the additive mixture may easily be transported to a plant for use. As disclosed in prior work, the prills are mixed in with the feed material at the desired weight ratio prior to combustion.

The thermal stability agent can be in the form of a liquid or slurry when contacted with the additive, thereby producing an additive mixture in the form of a liquid or slurry. For example, a magnesium hydroxide slurry was tested. This formulation was tested partly for the decomposition to MgO and to evaluate if it might help to slightly lower temperatures in the primary flame zone due to slurry moisture and endothermic decomposition. This formulation is relatively inexpensive and has proven safe in boiler injection. The formulation was made by blending a $Mg(OH)_2$ slurry with urea and spraying on the coal, adding only about 1 to 2% moisture. Generally, when added in liquid or slurry form the additive mixture includes a dispersant. Any commonly used dispersant may be used; a present preferred dispersant is an alkali metal (e.g., sodium) lignosulfonate. When applied in slurry form, ratios are approximately 40 wt. % thermal stability agent (e.g., magnesium hydroxide), 20 wt. % additive (e.g., urea), 39 wt. % water, and 1 wt. % dispersant. This can actually involve the determination of two ratios independently. First, the ratio of thermal stability agent to additive [Mg(OH)2:Urea] is determined. This ratio typically runs from about 0.5:1 to 8:1, and more typically is about 2:1. With that ratio established, the ratio of water to additive [H2O:urea] can be determined. That ratio again runs typically from about 0.5:1 to 8:1, and more typically is about 2:1. The slurry is typically applied onto the coal feed shortly before combustion.

An alternative approach to a thermal stability agent, not involving a thermal stabilizing agent, utilizes a radical scavenger approach to reduce NOx by introducing materials to scavenge radicals (e.g., OH, O) to limit NO formation. Thermal $NO_x$ formation is governed by highly temperature-dependent chemical reactions provided by the extended Zeldovich mechanism:

$$O+N2 \longleftrightarrow N+NO$$

$$N+O2 \longleftrightarrow O+NO$$

$$N+OH \longleftrightarrow H+NO$$

Examples of materials that can reduce $NO_x$ per the proposed radical scavenger method include alkali metal carbonates and bicarbonates (such as sodium bicarbonate, sodium carbonate, and potassium bicarbonate), alkali metal hydroxides (such as sodium hydroxide and potassium hydroxide), other dissociable forms of alkali metals (such as sodium and potassium), and various forms of iron including FeO, $Fe_2O_3$, $Fe_3O_4$, and $FeCl_2$. Sources of iron for the thermal stabilizing agent include BOF dust, mill fines, and other wastes. Engineered fine iron particle and lab grade products may also be utilized. Representative sources would include ADA-249™ and ADA's patented Cyclean™ technology, and additives discussed more fully in U.S. Pat. No. 6,729,248, U.S. Pat. No. 6,773,471, U.S. Pat. No. 7,332,002, U.S. Pat. No. 8,124,036, and U.S. Pat. No. 8,293,196, each of which are incorporated herein by this reference.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

Example 1

The additive was applied to the coal simply by adding the additive to a barrel of pulverized coal and mixing to simulate the mixing and sizing that would occur as the coal passed through a pulverizer at a full scale unit. The treated fuel was fed to the boiler at 20 lbs per hour, at combustion temperatures which exceeded 2000° F. in a combustion environment that consisted of burners. This configuration demonstrated up to a 23% reduction in NOx, as measured by a Thermo Scientific NOX analyzer.

Slurried additive mixtures comprising magnesium hydroxide and urea solution were evaluated in a pilot tangentially-fired coal combustor. The additive mixture was added to coal as slurry, which in practice could be accomplished either individually or in combination, prior to combustion.

Coal was metered into the furnace via four corner-located coal feeders at the bottom of the furnace. Combustion air and overfire air were added at a controlled rate measured by electronic mass flow controllers. The combustor exit oxygen concentration was maintained within a narrow range, targeted at the identical oxygen for both baseline and while firing treated coal. Tests were maintained at stable combustion with batched coal feed for at least 3 hours or longer. A flue gas sample was extracted from the downstream gas duct after a particulate control device (fabric filter or electrostatic precipitator) in order to measure $NO_x$ and other vapor constituents in an extractive continuous emission monitor. The gas was sampled through an inertial separation probe (QSIS probe), further eliminating interference from particulate or moisture. $NO_x$ concentration was measured dry basis with a Thermo-Electron chemiluminescent $NO_x$ monitor. The measured concentration was corrected to constant oxygen and expressed in units of lbs/MMBtu. Percent reduction was calculated from the average baseline and the average with treated coal for a given combustion condition.

As disclosed in Table 1 below, a slurried additive mixture comprising 0.10 wt. % urea and 0.60 wt. % magnesium hydroxide (by weight of coal) yielded a 21.5% reduction in $NO_x$ as compared to the baseline condition.

A second additive mixture comprising 0.25 wt. % urea and 0.25 wt. % magnesium hydroxide (by weight of coal) yielded a 13.7% reduction in $NO_x$ as compared to the baseline condition.

Pilot testing also was conducted with melamine as the additive in place of urea. In a tested condition, an additive mixture comprising 0.10 wt. % melamine and 0.50 wt. % magnesium hydroxide (by weight of coal) was added to the coal. While a 2.4% reduction in NOx was achieved with this additive, the $NO_x$ reduction was lower than that of the urea-containing additives.

Example 2

Another series of tests were conducted at the same pilot combustor with further optimized additive rates and different PRB coal, using the same procedures. Table 2 summarizes the results. With magnesium hydroxide at 0.4 wt. % by weight of coal and urea at 0.2 wt. % by weight of coal produced 21% $NO_x$ reduction. Further refinement produced 22-23% $NO_x$ reduction with 0.3 wt. % by weight magnesium hydroxide and 0.15 wt. % urea (by weight of coal). This reduction has also been achieved with 0.25% by weight Mg(OH)2 and 0.125% by weight urea in other tests.

TABLE 1

| Condition | Urea (% of coal feed) | Mg Hydroxide (% of coal feed) | Melamine (% of coal feed) | Baseline NOx (lbs/MMBtu) | Test NOx (lbs/MMBtu) | Reduction from Baseline (%) |
|---|---|---|---|---|---|---|
| Test 1 | 0.25 | 0.25 | 0 | 0.41 | 0.39 | 5.5 |
| Test 2 | 0.25 | 0.25 | 0 | 0.46 | 0.40 | 13.7 |
| Test 2a | 0.10 | 0.60 | 0 | 0.46 | 0.36 | 21.7 |
| Test 3 | 0 | 0.50 | 0.10 | 0.46 | 0.45 | 2.4 |
| Test 3a | 0.10 | 0.20 | 0 | 0.46 | 0.44 | 4.9 |

TABLE II

| Condition | Urea (% of coal feed) | Mg Hydroxide (% of coal feed) | Baseline NOx (lbs/MMBtu) | Test NOx (lbs/MMBtu) | Reduction from Baseline (%) |
|---|---|---|---|---|---|
| Test 4 | 0.10 | 0.60 | 0.46 | 0.41 | 10% |
| Test 5 | 0.20 | 0.40 | 0.46 | 0.36 | 21% |
| Test 6 | 0.15 | 0.30 | 0.46 | 0.35 | 23% |
| Test 7 | 0.15 | 0.30 | 0.46 | 0.36 | 22% |

Example 3

Earlier testing conducted at the same tangentially-fired pilot combustion facility firing PRB coal evaluated a variety of additive materials comprising a nitrogenous additive formulated in a heat resistant solid matrix. The additives were evaluated at a number of combustion air-fuel conditions ranging from very low excess air (stoichiometric ratio, SR, of 0.7) to a condition close to unstaged combustion (SR 0.92 to 1), Tests with low excess air did not achieve any additional NOx reduction. Tests at more normal excess air (SR=0.92 to 1) did show consistent reduction of NOx with both a nitrogenous reducing additive (urea) and with iron oxides. A detailed chart of tested materials is disclosed below. In the tested examples, BOF dust was comprised of a mix of iron oxides, Fe(II) and Fe(III), $Fe(II)Cl_2$, $Fe_2O_3$, and $Fe_3O_4$. A mixed solid labeled UFA was comprised of a powderized solid of coal fly ash and urea with lime binder. Powderized sodium bicarbonate (SBC) was also added. The additive, thermal stabilizing and binder materials were finely powderized and thoroughly mixed with coal in batches prior to combustion. As can be seen from the table, none of the tests were as successful as urea and magnesium hydroxide.

TABLE III

| Test # | Combustion Condition (Air-Fuel SR) | UFA (% of coal feed) | Urea (% of coal feed) | Iron Oxides (% of coal feed) | SBC (ppm of coal feed) | Baseline NOx (lbs/MMBtu) | Test NOx (lbs/MMBtu) | NOx Reduction (%) |
|---|---|---|---|---|---|---|---|---|
| 1-2 | 0.7 | 2.5% | 0.5% | 0.5% | 1300 | 0.27 | 0.272 | −0.74% |
| 1-3 | 0.78 | 2.5% | 0.5% | 0.5% | 1300 | 0.318 | 0.361 | −13.52% |
| 1-5 | 0.92 | 2.5% | 0.5% | 0.5% | 1300 | 0.679 | 0.624 | 8.10% |
| 2-2 | 0.7 | 0.0% | 0.0% | 0.5% | 700 | 0.27 | 0.274 | −1.48% |
| 2-3 | 0.78 | 0.0% | 0.0% | 0.5% | 700 | 0.318 | 0.323 | −1.57% |
| 2-5 | 0.92 | 0.0% | 0.0% | 0.5% | 700 | 0.679 | 0.574 | 15.46% |
| 3-2 | 0.7 | 2.5% | 0.5% | 0.0% | 1300 | 0.27 | 0.259 | 4.07% |
| 3-3 | 0.78 | 2.5% | 0.5% | 0.0% | 1300 | 0.318 | 0.33 | −3.77% |
| 3-5 | 0.92 | 2.5% | 0.5% | 0.0% | 1300 | 0.679 | 0.633 | 6.77% |

Example 4

$NO_X$ reduction tests were also performed at a second pulverized coal pilot facility with a single burner configured to simulate a wall fired boiler. During these tests, a slurry comprising 0.3% by weight of coal of $Mg(OH)_2$ and 0.15% of urea on the coal was tested under staged combustion conditions. The results show that under practical combustion burner stoichiometric ratios, $NO_X$ reductions in excess of 20% can be achieved in a second unit designed to represent wall fired pulverized coal boilers.

TABLE IV

| Fuel Identification: Powder River Basin | | | | | | |
|---|---|---|---|---|---|---|
| | | $NO_x$ Results | | | | |
| | BSR | $O_2$, % | $NO_x$, ppm | $NO_x$, ppm corrected to 3.50% $O_2$ | $NO_x$, lb/MMBtu | $NO_x$ Reduction, % |
| Feedstock | 0.75 | 4.21 | 143 | 149 | 0.207 | — |
| Refined 3 | 0.75 | 4.22 | 109 | 113 | 0.157 | 24.15 |
| Feedstock | 0.85 | 4.04 | 152 | 157 | 0.216 | — |
| Refined 3 | 0.85 | 4.00 | 119 | 123 | 0.171 | 20.83 |

The foregoing discussion of the invention has been presented for purposes of illustration and description, and is not intended to limit the invention to the form or forms disclosed herein. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

A number of variations and modifications of the disclosure can be used. It would be possible to provide for some features of the disclosure without providing others.

For example in one alternative embodiment, any of the above methods, or any combination of the same, can be combined with activated carbon injection for mercury and NOx control. The activated carbon may be combined with halogens, either before or during injection.

In another embodiment, any of the above methods, or any combination of the same, can be combined with dry sorbent injection (DSI) technology. Other sorbent injection combinations, particularly those used in conjunction with halogen injection, are disclosed in Publication US-2012-0100053-A1, which is incorporated herein by this reference.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A composition, comprising:

coal particles; and an additive composition to react with a contaminant from combustion of the coal particles, the additive composition comprising;

a nitrogenous material comprising one or more of ammonia, an amine, an amide, cyanuric acid, a nitride, and urea;

a binder; and a thermal stability agent comprising one or more of a metal hydroxide, metal carbonate, and metal bicarbonate, wherein the thermal stability agent is bound by the binder to and substantially surrounds the nitrogenous material and wherein a molar ratio of the thermal stability agent:nitrogenous material ranges from about 1:1 to about 10:1.

2. The composition of claim 1, wherein the coal is a high alkali coal, wherein the composition is fed to a combustor, wherein the coal particles and additive composition are mixed together, wherein a molar ratio of the thermal stability agent:nitrogenous material ranges from about 1:1 to about 8:1, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and wherein the nitrogenous material is one or more of an amine, amide, cyanuric acid, and urea.

3. The composition of claim 1, wherein the coal is a high iron coal, wherein the composition is fed to a combustor, wherein the coal particles and additive composition are mixed together, wherein a molar ratio of the thermal stability agent:nitrogenous material ranges from about 1:1 to about 8:1, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and wherein the nitrogenous material is one or more of an amine, amide, cyanuric acid, and urea.

4. The composition of claim 1, wherein the coal is a high sulfur coal, wherein the composition is fed to a combustor, wherein the coal particles and additive composition are mixed together, wherein a molar ratio of the thermal stability agent:nitrogenous material ranges from about 1:1 to about 8:1, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and wherein the nitrogenous material is one or more of an amine, amide, cyanuric acid, and urea.

5. The composition of claim 1, wherein a weight ratio of the thermal stability agent:nitrogenous material ranges from about 0.5:1 to about 8:1, wherein the nitrogenous material comprises urea, wherein an iron content of the coal is less than about 10 wt. % (dry basis of the ash) as $Fe_2O_3$, wherein an alkali content of the coal is at least about 20 wt. % (dry basis of the ash) alkali, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and wherein the thermal stability agent comprises one or more of an alkaline earth metal hydroxide, an alkaline earth metal carbonate, and an alkaline earth metal bicarbonate.

6. The composition of claim 1, wherein a weight ratio of the thermal stability agent:nitrogenous material ranges from about 0.5:1 to about 8:1, wherein the coal comprises at least about 15 wt. % calcium as CaO (dry basis of the ash), wherein the thermal stability agent forms, when the composition is combusted, one or more of a thermally protective barrier and heat sink around the nitrogenous material to reduce thermal degradation of the nitrogenous material, wherein the nitrogenous material comprises urea, wherein the binder is one or more of a wax, wax derivative, gum, gum derivative, and alkaline binding agent, and wherein the thermal stability agent comprises one or more of an alkaline earth metal hydroxide and an alkaline earth metal carbonate.

7. The composition of claim 1, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and further comprising one or more of a stabilizing agent and dispersant.

8. The composition of claim 1, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, wherein the binder is one or more of a wax, wax derivative, gum, gum derivative, and alkaline binding agent, and wherein the additive mixture comprises prills comprising urea and an alkaline earth metal hydroxide.

9. The composition of claim 1, wherein a molar ratio of the thermal stability agent:nitrogenous material ranges from about 1.5:1 to about 5:1, wherein the thermal stability agent forms, when the composition is combusted, one or more of a thermally protective barrier and heat sink around the nitrogenous material to reduce thermal degradation of the nitrogenous material, and wherein the binder is one or more of a wax, wax derivative, gum, gum derivative, and alkaline binding agent, and further comprising at least one halogen.

10. The composition of claim 9, wherein the at least one halogen is one or more of iodine and bromine.

11. A composition, comprising:

coal particles; and an additive composition to react with a contaminant from combustion of the coal particles, the additive composition comprising:

a nitrogenous material in the form of particles comprising one or more of ammonia, an amine, an amide, cyanuric acid, a nitride, and urea, wherein the nitrogenous material particles have an exterior surface; and a thermal stability agent bound to and substantially surrounding the exterior surface of the nitrogenous material particles to reduce thermal decomposition of the nitrogenous material, wherein the thermal stability agent comprises one or more of a metal hydroxide, metal carbonate, and metal bicarbonate and wherein a weight ratio of the thermal stability agent:nitrogenous material ranges from about 0.5:1 to about 8:1.

12. The composition of claim 11, wherein a weight ratio of the thermal stability agent:nitrogenous material ranges from about 1:1 to about 4:1, wherein the thermal stability agent is in contact with some, but not all of the exterior surface of the nitrogenous material particles, wherein the thermal stability agent forms, when the composition is combusted, one or more of a thermally protective barrier and heat sink around the nitrogenous material to reduce thermal degradation of the nitrogenous material, and wherein the thermal stability agent comprises ash.

13. The composition of claim 11, wherein a molar ratio of the thermal stability agent:nitrogenous material ranges from about 1:1 to about 10:1, wherein the thermal stability agent in contact with the exterior surface of the nitrogenous material particles thermally protects the nitrogenous material from one or more of combustion and thermal breakdown, wherein the thermal stability agent forms, when the composition is combusted, one or more of a thermally protective barrier and heat sink around the nitrogenous material to reduce thermal degradation of the nitrogenous material, and wherein the thermal stability agent comprises one or more of a metal hydroxide, metal carbonate, metal bicarbonate, and ash.

14. The composition of claim 11, wherein a molar ratio of the thermal stability agent:nitrogenous material ranges from about 1:1 to about 8:1, wherein the thermal stability agent in contact with the exterior surface of the nitrogenous material particles is a heat sink, wherein the thermal stability agent forms, when the composition is combusted, one or more of a thermally protective barrier and heat sink around the nitrogenous material to reduce thermal degradation of the nitrogenous material, and wherein the thermal stability agent comprises one or more of a metal hydroxide, metal carbonate, metal bicarbonate, and ash.

15. The composition of claim 11, wherein a molar ratio of the thermal stability agent:nitrogenous material ranges from about 1:1 to about 10:1 and wherein the nitrogenous material particulates further comprise a substrate and wherein the substrate is a porous matrix comprising one or more of zeolite, char, graphite, and ash.

16. The composition of claim 15, wherein the composition is fed to a combustor, wherein the coal particles and additive composition are mixed together, and wherein the substrate is one or more of flyash and bottom ash.

17. The composition of claim 16, wherein the substrate comprises from about 10 to about 90 wt % of the additive composition and wherein a molar ratio of the thermal stability agent:nitrogenous material ranges from about 1:1 to about 10:1.

18. The composition of claim 11, wherein a molar ratio of the thermal stability agent:nitrogenous material ranges from about 1.5:1 to about 5:1, wherein the composition is fed to a combustor, wherein the coal particles and additive composition are mixed together, and further comprising a binder, wherein the binder binds the thermal stability agent to the nitrogenous material.

19. The composition of claim 18, wherein the binder is one or more of a wax, wax derivative, gum, gum derivative, and alkaline binding agent.

20. The composition of claim 19, wherein the alkaline binding agent comprises one or more of an alkali hydroxide, alkali carbonate, alkali bicarbonate, lime, limestone, caustic soda, trona, alkaline earth metal hydroxide, alkaline earth metal carbonate, and alkaline earth bicarbonate.

21. The composition of claim 18, wherein the binder comprises from about 0 to about 5 wt % of the additive composition and wherein a molar ratio of the thermal stability agent:nitrogenous material ranges from about 1:1 to about 10:1.

22. The composition of claim 11, wherein a molar ratio of the thermal stability agent:nitrogenous material ranges from about 1:1 to about 10:1 and wherein the composition is in the form of one or more of a slurry and sludge and wherein the thermal stability agent comprises one or more of a metal hydroxide, metal carbonate, metal bicarbonate, metal hydrate, and metal nitride.

23. The composition of claim 11, wherein a weight ratio of the thermal stability agent:nitrogenous material ranges from about 1:1 to about 4:1, wherein the composition comprises solid particles, wherein the particles have a moisture level, wherein the thermal stability agent forms, when the composition is combusted, one or more of a thermally protective barrier and heat sink around the nitrogenous material to reduce thermal degradation of the nitrogenous material, wherein a molar ratio of the thermal stability agent:nitrogenous material ranges from about 1:1 to about 10:1, and wherein the thermal stability agent comprises one or more of a metal hydroxide, metal carbonate, metal bicarbonate, metal hydrate, and metal nitride.

24. The composition of claim 11, wherein a molar ratio of the thermal stability agent:nitrogenous material ranges from about 1:1 to about 10:1, wherein the thermal stability agent forms, when the composition is combusted, one or more of a thermally protective barrier and heat sink around the nitrogenous material to reduce thermal degradation of the nitrogenous material and wherein the thermal stability agent comprises one or more of a metal hydroxide, metal carbonate, and metal bicarbonate.

25. The composition of claim 11, wherein a molar ratio of the thermal stability agent:nitrogenous material ranges from about 1:1 to about 10:1, wherein the thermal stability agent forms, when the composition is combusted, one or more of a thermally protective barrier and heat sink around the nitrogenous material to reduce thermal degradation of the nitrogenous material, and further comprising coal, wherein the coal is one or more of a high alkali coal, a high iron coal, and a high sulfur coal.

26. The composition of claim 11, wherein a molar ratio of the thermal stability agent:nitrogenous material ranges from about 1:1 to about 10:1, wherein the thermal stability agent forms, when the composition is combusted, one or more of a thermally protective barrier and heat sink around the nitrogenous material to reduce thermal degradation of the nitrogenous material, and wherein the thermal stability agent comprises one or more of an alkaline earth metal hydroxide, an alkaline earth metal carbonate, and an alkaline earth metal bicarbonate.

27. The composition of claim 11, wherein a molar ratio of the thermal stability agent:nitrogenous material ranges from about 1:1 to about 10:1, wherein the thermal stability agent forms, when the composition is combusted, one or more of a thermally protective barrier and heat sink around the nitrogenous material to reduce thermal degradation of the nitrogenous material, and further comprising one or more of a stabilizing agent, dispersant, and binder.

28. The composition of claim 11, wherein a molar ratio of the thermal stability agent:nitrogenous material ranges from about 1:1 to about 10:1 and wherein the thermal stability agent forms, when the composition is combusted, one or more of a thermally protective barrier and heat sink around the nitrogenous material to reduce thermal degradation of the nitrogenous material and further comprising one or more of flyash and bottom ash.

29. The composition of claim 11, wherein a molar ratio of the thermal stability agent:nitrogenous material ranges from about 1:1 to about 10:1, wherein the thermal stability agent forms, when the composition is combusted, one or more of a thermally protective barrier and heat sink around the nitrogenous material to reduce thermal degradation of the nitrogenous material, and wherein the thermal stability agent comprises one or more of magnesium hydroxide, magnesium carbonate, and magnesium bicarbonate.

30. A composition, comprising:

particulate coal; and an additive composition to react with a contaminant from combustion of the coal particles, the additive composition comprising:

a nitrogenous material in the form of particles having an exterior particle surface and comprising one or more of ammonia, an amine, an amide, cyanuric acid, a nitride, and urea; and a thermal stability agent comprising an alkaline earth metal hydroxide, carbonate, and/or bicarbonate, wherein the thermal stability agent is bound to and in contact with at least part of the exterior particle surface and wherein a molar ratio of the thermal stability agent:nitrogenous material ranges from about 1:1 to about 10:1.

31. The composition of claim 30, wherein a molar ratio of the thermal stability agent:nitrogenous material ranges from about 1:1 to about 8:1, wherein the thermal stability agent thermally protects the nitrogenous material from one or more of combustion and thermal breakdown, wherein the thermal stability agent comprises one or more of a metal hydroxide, metal carbonate, metal bicarbonate, and ash, wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and wherein an iron content of the coal is less than about 10 wt. % (dry basis of the ash) as $Fe_2O_3$, and wherein an alkali content of the coal is at least about 20 wt. % (dry basis of the ash) alkali.

32. The composition of claim 30, wherein a weight ratio of the thermal stability agent:nitrogenous material ranges from about 0.5:1 to about 8:1, wherein the thermal stability agent is a heat sink, wherein the thermal stability agent comprises one or more of a metal hydroxide, metal carbonate, metal bicarbonate, and ash, wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and wherein an iron content of the coal is less than about 10 wt. % (dry basis of the ash) as $Fe_2O_3$, and wherein an alkali content of the coal is at least about 20 wt. % (dry basis of the ash) alkali.

33. The composition of claim 30, wherein a weight ratio of the thermal stability agent:nitrogenous material ranges from about 0.5:1 to about 8:1, wherein the nitrogenous material particulates further comprise a substrate, wherein the thermal stability agent forms, when the composition is combusted, one or more of a thermally protective barrier and heat sink around the nitrogenous material to reduce thermal degradation of the nitrogenous material, and wherein the thermal stability agent substantially surrounds the exterior particle surface, and wherein the substrate is a porous matrix comprising one or more of zeolite, char, graphite, and ash.

34. The composition of claim 33, wherein a molar ratio of the thermal stability agent:nitrogenous material ranges from about 1.5:1 to about 5:1, and wherein the composition is fed to a combustor, and wherein the coal particles and additive composition are mixed together, and wherein the substrate is one or more of flyash and bottom ash.

35. The composition of claim 33, wherein a weight ratio of the thermal stability agent:nitrogenous material ranges from about 1:1 to about 4:1, and wherein the substrate comprises from about 10 to about 90 wt % of the additive composition.

36. The composition of claim 30, wherein a weight ratio of the thermal stability agent:nitrogenous material ranges from about 0.5:1 to about 8:1, and wherein the composition is fed to a combustor, wherein the coal particles and additive composition are mixed together, and further comprising a binder, wherein the binder adheres the thermal stability agent to the nitrogenous material.

37. The composition of claim 36, wherein a molar ratio of the thermal stability agent:nitrogenous material ranges from about 1.5:1 to about 5:1, and wherein the binder comprises from about 0 to about 5 wt % of the additive composition.

38. The composition of claim 36, wherein a weight ratio of the thermal stability agent:nitrogenous material ranges from about 1:1 to about 4:1, and wherein the binder is one or more of a wax, wax derivative, gum, gum derivative, and alkaline binding agent.

39. The composition of claim 38, wherein a molar ratio of the thermal stability agent:nitrogenous material ranges from about 1.5:1 to about 5:1, and wherein the alkaline binding agent comprises one or more of an alkali hydroxide, alkali carbonate, alkali bicarbonate, lime, limestone, caustic soda, trona, alkaline earth metal hydroxide, alkaline earth metal carbonate, and alkaline earth bicarbonate.

40. The composition of claim 30, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and wherein the composition is in the form of one or more of a slurry and sludge.

41. The composition of claim 30, wherein a weight ratio of the thermal stability agent:nitrogenous material ranges from about 0.5:1 to about 8:1, wherein the composition comprises solid particles, wherein the particles have a moisture level, wherein the thermal stability agent forms, when the composition is combusted, one or more of a thermally protective barrier and heat sink around the nitrogenous material to reduce thermal degradation of the nitrogenous material, and wherein the thermal stability agent substantially surrounds the exterior particle surface.

42. The composition of claim 30, wherein a weight ratio of the thermal stability agent:nitrogenous material ranges from about 0.5:1 to about 8:1, and wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and wherein the thermal stability agent comprises one or more of magnesium hydroxide, magnesium carbonate, and magnesium bicarbonate.

43. The composition of claim 30, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and further comprising coal, and wherein the coal is one or more of a high alkali coal, a high iron coal, and a high sulfur coal.

44. The composition of claim 30, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, and wherein the thermal stability agent substantially surrounds the exterior particle surface, and further comprising one or more of a stabilizing agent, dispersant, and binder.

45. The composition of claim 30, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, and wherein the thermal stability agent substantially surrounds the exterior particle surface, and further comprising one or more of flyash and bottom ash.

46. The composition of claim 30, wherein a weight ratio of the thermal stability agent:nitrogenous material ranges from about 0.5:1 to about 8:1, wherein the thermal stability agent forms, when the composition is combusted, one or more of a thermally protective barrier and heat sink around the nitrogenous material to reduce thermal degradation of the nitrogenous material, wherein the thermal stability agent substantially surrounds the exterior particle surface, and wherein the thermal stability agent comprises one or more of magnesium hydroxide, magnesium carbonate, and magnesium bicarbonate.

* * * * *